US006399146B1

(12) United States Patent
Harris et al.

(10) Patent No.: US 6,399,146 B1
(45) Date of Patent: Jun. 4, 2002

(54) METHOD OF APPLYING A CORROSION-RESISTANT COATING

(75) Inventors: Ivor Rex Harris, Birmingham; John D. Speight, Suffolk, both of (GB)

(73) Assignee: The University of Birmingham, Birmingham (GB)

( * ) Notice: Subject to any disclaimer, the term of this patent is extended or adjusted under 35 U.S.C. 154(b) by 0 days.

(21) Appl. No.: 09/623,070

(22) PCT Filed: Feb. 26, 1999

(86) PCT No.: PCT/GB99/00586

§ 371 (c)(1),
(2), (4) Date: Nov. 10, 2000

(87) PCT Pub. No.: WO99/43862

PCT Pub. Date: Sep. 2, 1999

(30) Foreign Application Priority Data

Feb. 26, 1998 (GB) ..... 9803970

(51) Int. Cl.[7] ..... B05D 5/12

(52) U.S. Cl. ..... 427/127; 264/82; 264/109; 264/129; 427/212; 427/214; 427/216; 427/217; 427/250; 427/255.19; 427/294; 427/295; 427/419.2

(58) Field of Search ..... 427/127, 212, 427/214, 216, 217, 250, 255.19, 294, 295, 419.2; 264/82, 109, 129

(56) References Cited

U.S. PATENT DOCUMENTS 3,286,684 A 11/1966 Aves ..... 118/48

FOREIGN PATENT DOCUMENTS

| | | |
|---|---|---|
| DE | 102291 | 10/1922 |
| EP | 0 255 816 | 7/1987 |
| FR | 487051 | 3/1915 |
| FR | 545282 | 12/1921 |
| GB | 352202 | 7/1931 |
| GB | 498371 | 1/1939 |
| JP | 04205717 | 7/1992 |

OTHER PUBLICATIONS

XP–002104800 Database, AN 92–311009, Derwent Publications Ltd., London, GB, Aug. 5, 1992.
XP–002104801 Database, AN 91–093299, Derwent Publications Ltd., London, GB, Jul. 30, 1990.

*Primary Examiner*—Bernard Pianalto
(74) *Attorney, Agent, or Firm*—Wells St. John P.S.

(57) ABSTRACT

This invention, in one aspect, relates to a method of applying a corrosion-resistant coating on an article and is particularly, but not exclusively, concerned with a method of applying a corrosion-resistant coating on an Nd—Fe—B magnet. In another aspect, the present invention relates to a method of applying a coherent coating on the surfaces of the particles of a powder. Such powder may be one which is susceptible to oxidative corrosion and/or one which is used to form a magnet (e.g Nd—Fe—B powder).

21 Claims, No Drawings

METHOD OF APPLYING A CORROSION-RESISTANT COATING

The commercial use of Nd—Fe—B magnets, particularly in the automobile industry, has been limited because of the susceptibility of such material to corrosion when exposed to a humid environment.

It is known to protect Nd—Fe—B magnets against corrosion by using various coating processes based generally on nickel, cadmium and aluminium. However, these coating processes are either too expensive for commercial application or they do not provide adequate long term corrosion protection.

Zinc coating of ferrous-based materials is widely practised. Various procedures are known for this. Hot dipping in molten zinc at about 430° C. (galvanising) is known. However, for application to Nd—Fe—B magnets, galvanising can cause cracking of the magnets due to thermal shock and also there is poor control over zinc penetration into the magnet, thereby leading to unacceptable variations in the corrosion protection afforded by galvanising.

It is also known to electroplate by cathodic deposition of zinc. However, such electroplating procedure when applied to Nd—Fe—B magnets leads to embrittlement of the material by hydrogen absorption.

It is also known to provide a zinc coating by means of the so-called sherardising process, wherein the article to be zinc-coated is tumbled in a rotating barrel containing zinc dust and sand at 380° C. However, such a sherardising process when applied to Nd—Fe—B materials leads to unacceptable oxidation thereof.

It is an object of said one aspect of the present invention to obviate or mitigate the above disadvantages by providing a process for applying a corrosion-resistant coating on an article which can be performed with reduced risk of cracking and oxidation of the article.

According to said one aspect of the present invention, there is provided a method of applying a corrosion-resistant coating to an article, comprising the steps of embedding the article in a mass of particles containing a sublimable corrosion-resistant material or a precursor thereof, and heating the embedded article at a temperature below the solidus temperature of the corrosion-resistant material under a pressure of less than 65 Pa so as to cause a coherent layer of the corrosion-resistant material to be formed on the article by sublimation.

Also according to said one aspect of the present invention, there is provided an article when coated with a corrosion-resistant coating by the method as defined in the last-preceding paragraph.

The article is preferably a magnet formed, for example, of Nd—Fe—B. The pressure during the heating step is preferably not more than about 13.3 Pa($1\times10^{-1}$ Torr).

The embedding procedure is preferably conducted by introducing the article and the particles into an envelope so that the particles completely surround the article, closing the envelope without sealing it, and then introducing the thus-filled envelope into a vacuum furnace. A getter, such as mischmetal, may be employed to absorb oxygen in the furnace.

When embedding the article in the mass of particles, it is highly preferred for all parts of the article to be embedded substantially uniformly in the particles.

The sublimable corrosion-resistant material may be a sublimable corrosion-resistant metal or alloy. Preferably, the sublimable corrosion-resistant material is zinc, magnesium or cadmium or an alloy of any two or more of these, e.g. a Zn/Mg alloy or a Mg/Cd alloy. The precursor of such material may be one which generates the material under the pressure and temperature conditions prevailing in the furnace. For example, the precursor may be a compound which is reducible to form said sublimable corrosion-resistant material, in which case the mass of particles may include a reducing agent.

The temperature of the furnace depends upon the nature of the sublimable corrosion-resistant material. In the case of zinc, the temperature of the furnace is preferably no higher than 390° C., and is more preferably in the range of 350 to 390° C., although it is considered that the temperature may be as low as about 250° C. provided that the pressure is appropriately low and/or the treatment time is appropriately long. For corrosion resistance purposes, it is preferred to provide a layer thickness of 15–30 $\mu$m . For such coatings, at a treatment temperature of 390° C. and a pressure of 13.3 Pa, the required thickness can be achieved in about 1 to 2 hours.

For anti-corrosion magnesium coatings, the temperature is typically about 450–500° C.

For anti-corrosion cadmium coatings, the temperature is typically about 250–300° C.

For alloy coatings with zinc, the temperature is typically derived from the ranges for the alloy ingredients, Thus, for Zn/Cd alloy, the temperature is typically 390–280° C. for anti-corrosion coatings.

In the case of zinc, temperatures in excess of 390° C. should be preferably avoided because the likelihood of agglomeration of zinc dust/powder on the surface is increased, thereby leading to a less uniform finish. This applies particularly to Nd—Fe—B materials.

The particles forming the mass in which the article is embedded preferably comprise a mixture of particles of the sublimable corrosion-resistant material or precursor thereof together with a particles of an inert diluent. Thus, the particles may comprise zinc dust, zinc powder and sand as the particulate inert diluent. The zinc dust typically has a particle size of 5 to 10 $\mu$m. The zinc powder typically has a particle size of 50 to 75 $\mu$m. The proportions of sand, zinc dust and zinc powder are typically 24:17:3 parts by weight.

The envelope may take the form of a stainless steel foil which is closed by crimping to an extent sufficient to retain the contents therein but not sufficient to seal the envelope hermetically.

Particularly in the case of articles in the form of Nd—Fe—B magnets, it may be required, before the embedding step, to prepare the surface, eg by abrading the article gently, e.g. with emery paper, and then cleaning it, e.g. by swabbing, with a hot solvent, e.g. an alcohol such as ethanol. However, it has been found that these surface preparation and cleaning procedures can be avoided by forming a controlled thin layer (0.05 to 1.0 $\mu$m) of oxide on the surface of the article, particularly a magnet such as an Nd—Fe—B magnet. This is found also to provide a further degree of protection to the underlying magnet.

The method of the present invention has the advantage over sherardising that no rotation of the embedded article in a barrel is required and there is enhanced uniformity of coating and article coverage.

In said another aspect of the present invention, there is provided a method of coating a powder, comprising the steps of mixing the powder with particles of a sublimable material or a precursor thereof, and heating the resultant mixture at a temperature below the solidus temperature of the said particles under a pressure of less than $1\times10^5$ Pa so as to cause a coherent layer of the sublimable material to be formed on the powder by sublimation.

Also according to said another aspect of the present invention, there is provided a powder when coated with a layer by the method as defined in the last-preceding paragraph.

The method according the said another aspect of the present invention is suitable for applying corrosion-resistant coatings (such as those mentioned above in relation to the coating of articles) to powders which are susceptible to oxidative and/or atmospheric corrosion, e.g. Nd—Fe—B powders which are formed from the bulk alloy by grinding, or by crushing or hydrogen decrepitating followed by milling, before being formed to the required shape (e.g. by compaction with or without subsequent sintering or by moulding using a resin binder, e.g. PTFE). In the case of resin-bonded articles such as magnets, it is particularly preferred to use PTFE which is effective for excluding oxygen and moisture).

It is also considered possible to form a controlled thin layer oxide layer on the surfaces of powders, eg Nd—Fe—B powders, prior to forming the coherent layer thereon, in an analogous manner to that described above for the corrosion protection of articles according to said one aspect of the present invention.

The method according the said another aspect of the present invention is also suitable for the coating of magnetic particles, whether or not they are susceptible to oxidation and/or oxidative corrosion, for the purpose of improving the magnetic properties of magnets formed from such powders. In this respect, coercivity can be improved by the provision of a surface coating on the magnetic particles so as to inhibit the nucleation of reverse magnetic domains on demagnetisation. When a metal such as zinc is used to coat particles of Nd —Fe—B, the zinc alloys with free Nd which has migrated to the surface of the particles. Additionally, the coating tends to reduce the surface roughness of the particles and results in particles of improved spheroidal shape which assists in preventing reverse domain nucleation and in improving densification during subsequent compaction of the coated particles to form a densified body.

The sublimable materials and processing techniques referred to above in connection with the coating of articles in accordance with said one aspect of the present invention are also considered to be suitable for the coating of particles in accordance with said another aspect of the present invention. Additionally, articles which have been formed from coated particles produced according to said another aspect may also be coated in accordance with said one aspect to enhance further the corrosion resistance of the article.

With further regard to the coating of powders (especially magnetic powders), it is preferred for the thickness of the coating on the powder to be in the range of about 50 to 100 nm for powders having a particle size in the range of about 3 to 10 $\mu$m, which is especially preferred for magnetic powders. This means that the coating need only occupy about 1 to 2 vol % of the total volume of the coated powder.

Zinc coating of powders has been demonstrated using 100 $\mu$m radius Nd—Fe—B powders. By mixing these powders with zinc powder, zinc dust and sand and heating at 370° C. for a process time of 30 minutes, Nd—Fe—B powders were uniformly coated with 2.5 $\mu$m of zinc. The thus coated magnetic powder is separated from the sand by magnetic separation. Layers of zinc having a thickness of 1 $\mu$m or less on Nd—Fe—B material are achievable using the same procedure at temperatures in the range 250–300° C. e.g. a 1 $\mu$m layer of zinc can be grown at 285° C. in 2.5 hours.

For Nd—Fe—B powders coated with 2.5 $\mu$m of zinc, as above, the coercivity of the powder is reduced by around 5% and the remanence is in direct proportion to the amount of Nd—Fe—B consumed by the Zn coating. Epoxy bonded magnets fabricated from zinc coated Nd—Fe—B powders have shown only slight signs of corrosion after 100 hours autoclave exposure. Identical magnets made from uncoated Nd—Fe—B powders disintegrate after 50 hours, or less, under the same test conditions. Precise gravimetric studies have shown that Nd—Fe—B powders coated with around 1 $\mu$m zinc show no evidence of weight increase, hence oxidation, when heated in air for 60 hours at 200° C. Uncoated, but otherwise identical powders show steady weight increments, hence oxidation, with time under the same conditions. Thus, it is considered that the thin zinc coatings make both handling and storage easier.

Slow rotation of the mix at, for example, 5 rpm or less aids uniform powder coating. In connection with the coating of the powder with zinc, for a zinc coating on the powder, at temperatures in the region of 250° C., under a pressure of about 13.3 Pa, a coating rate of about 0.1 $\mu$m/hr is achievable. Low pressures are preferred to limit oxidation of the powder. For magnesium powder coatings, the temperature may be as low as about 350° C. For cadmium powder coatings, the temperature may be as low as 200° C.

In the case where coating of magnetic powder is effected using particulate sublimable material or a precursor thereof mixed with a particulate diluent such as sand, the coated particles can be readily separated from the diluent particles by magnetic separation.

The present invention will now be described in further detail in the following Examples.

EXAMPLE 1

Pressed and sintered Nd—Fe—B magnets are first cleaned by degreasing them using trichloroethylene in a reflux degreasing system. Alternatively, any other degreaser may be used such as Genkleen. The magnets are then rinsed in ethanol and blow dried. Further cleaning of the magnets is performed by grit blasting or by abrasion using a moderate grinding paper. Such abrasive cleaning is then followed by a further hot ethanol rinse and subsequent blow dry.

The resulting clean magnets are embedded in a freshly prepared mixture consisting of 17 parts by weight of zinc dust (particles 5–10 $\mu$m), 3 parts by weight of zinc powder (particle size 50–75 $\mu$m) and 25 parts by weight of sand (clean silica or zeolite sand). The mixture is prepared by initially mixing the ingredients manually and then tumbling them at low speed (30 rpm) to attain homogeneity.

The magnets embedded in the powder are then enclosed in a stainless steel foil capsule which is then closed by crimping so as to seal the capsule, but not hermetically.

The closed capsule is then introduced into a vacuum furnace and typically heated at 390° C. for one hour at a pressure of 13.3 Pa. As a result of this treatment, a zinc coating having a thickness of about 20 $\mu$m is provided on the outside surfaces of the magnets. Typically, the capsule takes around 30 minutes to reach the process temperature. After the required process time, the furnace is allowed to cool to room temperature whilst the capsule is maintained under the reduced pressure. Following treatment, the capsule is opened and the magnets are given a gentle sand tumble and final blow clean with dry air in order to remove excess process powders.

B—H measurements on Nd—Fe—B magnets show that all the main magnetic parameters, remanence, coercivity and squareness are within 1–2% of the original values following coating with 30 $\mu$m Zn using a process as described above but modified by treatment treated for two hours, rather than one hour, at 390° C.

Preliminary gravimetric studies, under autoclave conditions (air-saturated with water vapour at 100° C. and 100 KPa) on Nd—Fe—B magnets coated with a 15 μm thick Zn layer, show 50% less corrosion than for uncoated but otherwise identical samples. Electroplated zinc coated Nd—Fe—B magnets typically disintegrate after 30 hours of autoclave exposure.

EXAMPLE 2

Example 1 is repeated, except that initially, instead of abrading the magnets, and rinsing and drying them, a thin layer of oxide is grown on the magnets by heating them in air (heating for two hours at 265° C. produces an oxide layer 0.15 μm thick) before embedding and heating them in the vacuum furnace for one hour at 390° C. produces a zinc coating having a thickness of about 10 μm.

In tests, it is found that a zinc coated Nd—Fe—B magnet with a pre-grown 0.15 μm thick oxide layer shows a corrosion resistance which is at least twice that of an equivalent zinc coated magnet without the pre-grown oxide layer.

EXAMPLE 3

Nd—Fe—B magnet powder is cleaned by tumbling with silica sand for 1 hour in a non-oxidising atmosphere, eg argon or nitrogen. The clean magnet powder is separated from the sand by magnetic separation, eg by application of a magnetic field of about 1.3 Tesla using a permanent magnet.

The clean and separated Nd—Fe—B powder is mixed with a freshly prepared mixture consisting of 17 parts by weight zinc dust (particle size 5–10 μm), 3 parts by weight zinc powder (particle size 50–75 μm) and 25 parts by weight sand. The mixture is prepared by initially tumbling at low speed (30 rpm) to attain homogeneity. All the above operations are carried out in an inert atmosphere to minimise oxidation of the Nd—Fe—B powder.

The resultant powder mixture is then enclosed in a stainless steel foil capsule by crimping so as to seal the capsule, but not hermetically.

The closed capsule is then introduced into a vacuum furnace and typically heated at 370° C. for 30 minutes at a pressure of 13.3 Pa. As a result of this treatment, a zinc coating having a thickness of about 2.5 μm is provided on the outside surfaces of the magnet powder. Typically, the capsule takes around 30 minutes to reach the process temperature. After the required process time, the furnace is allowed to cool to room temperature whilst the capsule is maintained under the reduced pressure. Thicker or thinner coatings of zinc may be formed by appropriate choice of the process conditions, as indicated hereinabove.

Following the treatment, the capsule is opened and the zinc coated magnet powder is separated from the residual sand by magnetic separation. Again, a field of about 1.4 Tesla is suitable.

The resistance to oxidation and corrosion of Nd—Fe—B powder is much enhanced by zinc coating. Nd—Fe—B (200 μm diameter) coated with 5 μm of zinc using the above process shows a 20 fold lower rate of corrosion than for the uncoated, but otherwise identical, powders when exposed to an 85° C./85% RH atmosphere for 300 hours.

What is claimed is:

1. A method of applying a corrosion-resistant coating to an article, comprising the steps of embedding the article in a mass of particles containing a sublimable corrosion-resistant material or a precursor thereof, and heating the embedded article at a temperature below the solidus temperature of the corrosion-resistant material under a pressure of less than 65 Pa so as to cause a coherent layer of the corrosion-resistant material to be formed on the article by sublimation.

2. A method as claimed in claim 1, wherein the article is a magnet.

3. A method as claimed in claim 2, wherein the magnet is formed of Nd—Fe—B.

4. A method as claimed in claim 1 wherein the pressure during the heating step is not more than about 13.3 Pa.

5. A method as claimed in claim 1, wherein the embedding step is conducted by introducing the article and the particles into an envelope so that all parts of the article are embedded substantially uniformly in the particles, closing the envelope without sealing it, and then introducing the thus-filled envelope into a vacuum furnace in which the heating step is performed.

6. A method as claimed in claim 1, wherein the sublimable corrosion-resistant material is a sublimable corrosion-resistant metal or alloy.

7. A method as claimed in claim 6, wherein the sublimable corrosion-resistant material is zinc and the temperature of the heating step does not exceed 390°C.

8. A method as claimed in claim 7, wherein the temperature is 350 to 390° C.

9. A method as claimed in claim 6, wherein the sublimable corrosion-resistant material is magnesium and the temperature of the heating step is in the range of 450 to 500° C.

10. A method as claimed in claim 6, wherein the sublimable corrosion-resistant material is cadmium and the temperature of the heating step is in the range of 250 to 300° C.

11. A method as claimed in claim 1, wherein in the embedding step the particles forming the mass in which the article is embedded comprise a mixture of particles of the sublimable corrosion-resistant material or precursor thereof together with particles of an inert diluent.

12. A method as claimed in claim 1, where, prior to the embedding step, an oxide layer of controlled thickness is formed on the surface of the article.

13. A method as claimed in claim 12, wherein the oxide layer has a thickness of 0.05 to 1.0 μm.

14. A method of coating a powder, comprising the steps of mixing powder with particles of a sublimable material or a precursor thereof, and heating the resultant mixture at a temperature below the solidus temperature of the said particles under a pressure of less than $1\times10^5$ Pa so as to cause a coherent layer of the sublimable material to be formed on the powder by sublimation.

15. A method as claimed in claim 14, wherein, prior to said mixing step, an oxide layer of controlled thickness is formed on the surfaces of the particles.

16. A method as claimed in claim 14, wherein the powder is a magnetic powder.

17. A method as claimed in claim 14, wherein the magnetic powder is an Nd—Fe—B powder.

18. A method as claimed in claim 14, wherein the coating on the powder is zinc or a zinc alloy.

19. A method as claimed in claim 14, wherein the thickness of the coating on the powder is in the range of about 50 to 100 nm, and the powder has a particle size in the range of about 3 to 10 μm.

20. A method as claimed in claim 14, wherein the coated powder is subsequently shaped to form an article.

21. A method as claimed in claim 20, wherein the article is coated by a method as claimed in claim 1.

* * * * *